United States Patent [19]

Tissington et al.

[11] Patent Number: 4,765,105

[45] Date of Patent: Aug. 23, 1988

[54] WALL PANEL WITH FOAM INSULATION

[75] Inventors: Sidney K. Tissington; Henry J. Scheunhage; Clare M. Johnston; Frederick B. Tissington, all of Grande Prairie, Canada

[73] Assignee: Seven S Structures Inc., Alberta, Canada

[21] Appl. No.: 64,479

[22] Filed: Jun. 22, 1987

Related U.S. Application Data

[63] Continuation-in-part of Ser. No. 876,027, Jun. 19, 1986, abandoned.

[51] Int. Cl.[4] ..... E04B 1/00

[52] U.S. Cl. ..... 52/309.11; 52/282; 264/46.5

[58] Field of Search ..... 52/309.9, 309.11, 281, 52/265, 793, 309.4, 309.7, 309.8, 727, 282

[56] References Cited

U.S. PATENT DOCUMENTS

| | | | |
|---|---|---|---|
| 3,254,464 | 6/1966 | Hoyt, Jr. | 52/309.9 |
| 3,305,986 | 2/1967 | Mathews | 52/309.11 X |
| 3,327,441 | 6/1967 | Kelly | 52/309 |
| 3,462,897 | 8/1969 | Weinrott | 52/309.11 X |
| 3,472,728 | 10/1969 | Hitch | 161/69 |
| 3,697,633 | 10/1972 | Edgar | 264/45 |
| 3,708,385 | 1/1973 | Immethum | 161/69 |
| 3,782,049 | 1/1974 | Sachs | 52/309 |
| 3,846,203 | 11/1974 | Immethum | 156/265 |
| 3,949,529 | 4/1976 | Porter | 52/727 X |
| 4,114,333 | 9/1978 | Jones | 52/265 |
| 4,147,004 | 4/1979 | Day et al. | 52/309.9 |
| 4,163,349 | 8/1979 | Smith | 52/309.7 X |
| 4,216,634 | 8/1980 | Binder | 52/309.9 |
| 4,269,006 | 5/1981 | Larrow | 52/79.1 |
| 4,329,827 | 5/1982 | Thorn | 52/793 |
| 4,443,988 | 4/1984 | Couta· | 52/309.9 |
| 4,471,591 | 9/1984 | Jamison | 52/309.9 |
| 4,578,909 | 4/1986 | Henley et al. | 52/309.11 |

FOREIGN PATENT DOCUMENTS

| | | |
|---|---|---|
| 705580 | 3/1965 | Canada . |
| 791361 | 8/1968 | Canada . |
| 795009 | 9/1968 | Canada . |
| 1041728 | 11/1978 | Canada . |
| 1116371 | 1/1982 | Canada . |
| 1124482 | 6/1982 | Canada . |
| 938294 | 9/1948 | France . |

*Primary Examiner*—Carl D. Friedman

*Attorney, Agent, or Firm*—Beveridge, DeGrandi & Weilacher

[57] ABSTRACT

A wall panel of the type having two outer sheathing boards separated by rigid foam insulation has a continuous top header and a base reinforcement which are also each formed of two boards separated by rigid foam insulation. Vertical stud members formed of elongated boards have a central web extending between the boards of the top header and of the base reinforcement, and have side flanges nailed and bonded to the sheathing boards and extending between the bottom of the header and the top of the base reinforcement. The stud flanges allow nails to be applied internally of a flange into a first of the outer sheathing boards. The wall panels may have window and door openings cut out underneath the header after the foam has hardened between the panels.

5 Claims, 6 Drawing Sheets

WALL PANEL WITH FOAM INSULATION

Figure 2:
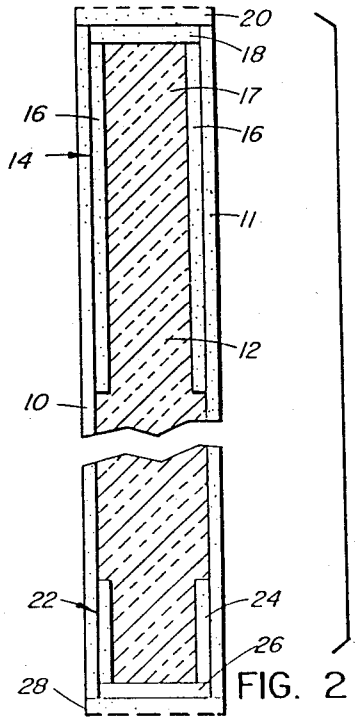

This application is a continuation-in-part of our U.S. patent application Ser. No. 876,027 filed June 19, 1986, now abandoned.

The present invention relates to wall panels for buildings and especially houses, the panels being of the type having two outer sheathing boards separated by rigid foam insulation.

In many previously known panels of this type, wooden studs span the gap between the sheathing boards and provide thermal bridges which impair the insulating quality of the panels. Attempts have been made to avoid such thermal bridges, and such constructions are shown for example in Canadian Pat. Nos. 1,041,728 issued Nov. 7, 1978 to Samuelsson, and 1,124,482 which issued June 1, 1982 to Slater, and U.S. Pat. No. 4,329,827 which issued May 18, 1982 to Thorn.

In some prior constructions, for example in the Larrow U.S. Pat. No. 4,269,006, the panels are relatively narrow in width and separate designs of panels are used for unapertured wall areas, wall areas with windows, and door openings. In other proposals, for example that of the Edgar U.S. Pat. No. 3,697,633, relatively long panels are used (having a length greater than their height), and window and/or door openings are provided in a panel which also has a length of uninterrupted wall. In a typical known system using long panels of this kind, a window or door opening is provided by pre-cutting suitable apertures in the sheathing boards before forming the panel, placing the sheathing boards in spaced position in a mold or suitable holding apparatus, and then framing around the opening so that when the foam is injected between the panels it does not spill into this opening. The provision of this frame involves significant labor cost in panels formed in this way. In U.S. Pat. No. 4,147,004 which issued Apr. 3, 1979 to Day et al, window apertures are cut from the finished panel, but these require framing afterwards.

The present invention provides wall panels which have a suitable strength and yet in which thermal bridges are minimized. Also, the invention allows long wall panels to be produced from which windows and/or door openings can be cut if necessary, without any additional framing being required; although it is preferred that large openings be formed by separate components above a door and above and below a window. The panel of this invention avoids the need for framing of openings by the provision of a continuous top header extending the full length of the panel and supported internally of the panel by stud members designed for minimum thermal bridging.

In the wall panel of this invention, the continuous top header comprises a pair of upper boards located against upper margins of the opposed interior surfaces of the sheathing boards and further comprises a transverse top bearing plate overlying the upper edges of the upper boards. The panel also has a base reinforcement comprising a pair of lower boards having the same thickness as the upper boards and located against lower margins of the interior surfaces and a transverse lower bearing plate underlying the edges of the lower boards. The panel further comprises a series of vertical stud members each having a central web and a nailing flange along one edge of said web, the flange being internally nailed to one of said sheathing boards, and having an opposite edge element holding nails applied through said other sheathing board, the central web having end extensions fitting between the pair of upper boards to the top bearing plate and between the pair of lower boards to the lower bearing plate. The flange and edge element provide parts lying between the edges of the web and said sheathing boards; these parts each have a thickness equivalent to the upper and lower boards and these span the vertical spaces between adjacent edges of said upper and lower boards so that the stud members support the header. All spaces between the sheathing boards and upper and lower pairs of boards are filled with rigid foam insulation.

Any small window opening may be situated with its top immediately below the header, and the header provides the sole reinforcement above such opening.

Preferably the web of each stud member is a parallel sided board dimensioned so that its end extensions fit perpendicularly between the pair of upper boards and the pair of lower boards, and the nailing flange and said opposite edge element are each constituted by a strip of board material secured perpendicularly to the outer edges of the said web.

Figure 1:
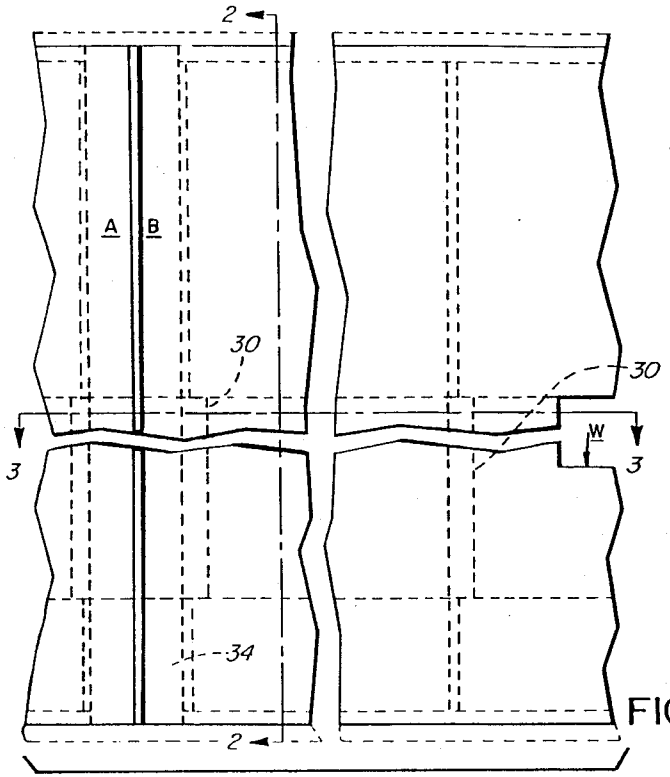
Figure 3:
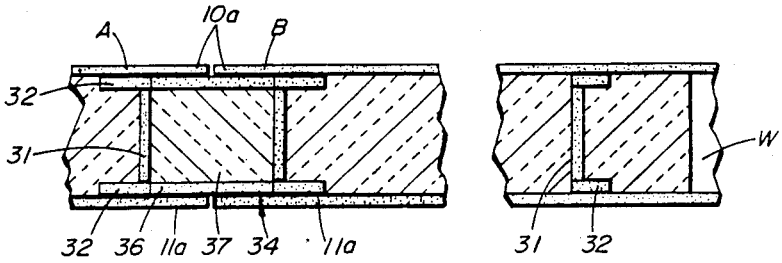
Figure 4A:
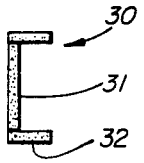
Figure 5A:
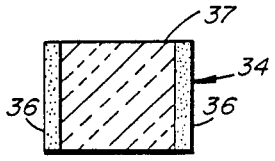
Figure 4B:
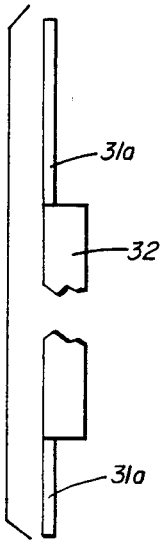
Figure 5B:
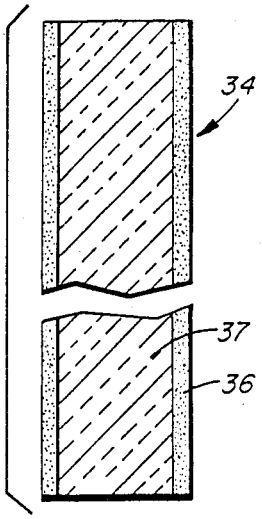
Figure 6A:
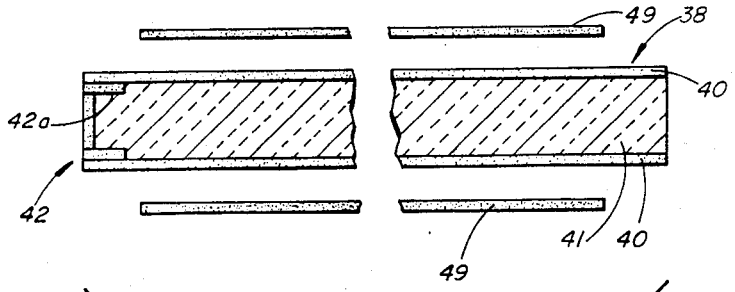
Figure 6B:
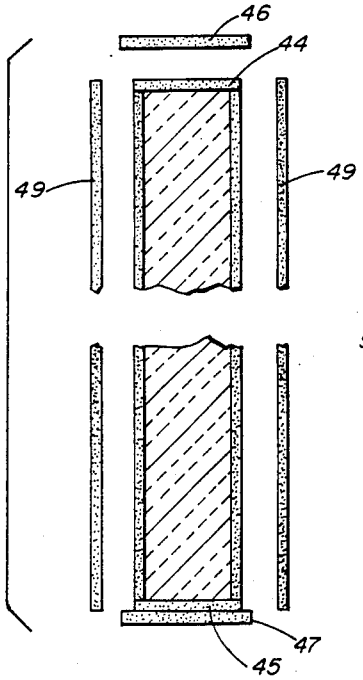
Figure 7:
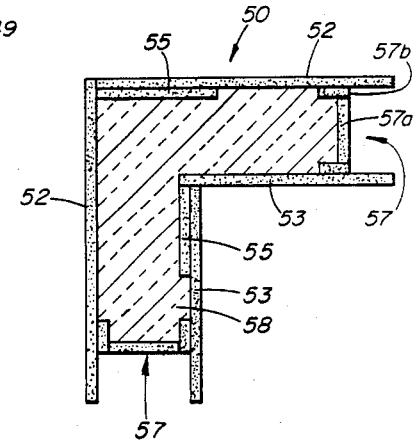
Figure 8:
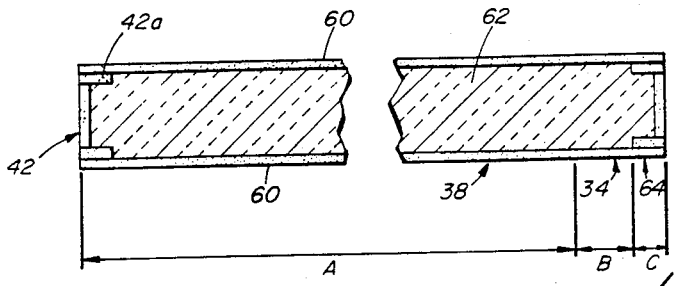
Figure 9A:
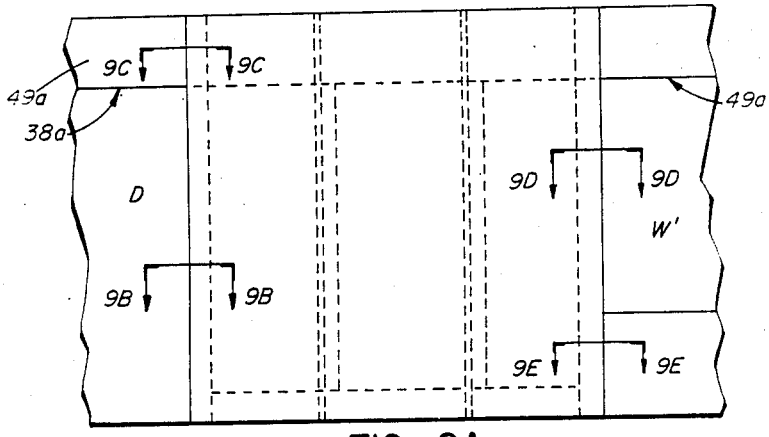
Figure 9B:
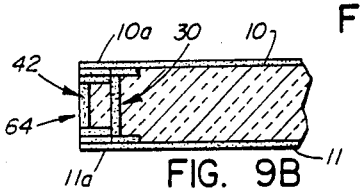
Figure 9D:
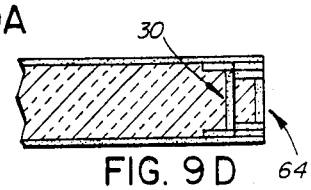
Figure 9C:
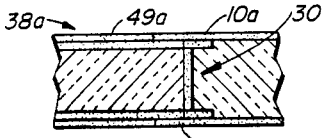
Figure 9E:
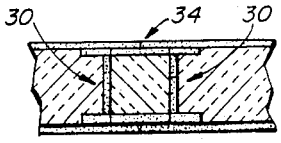
Figure 11:
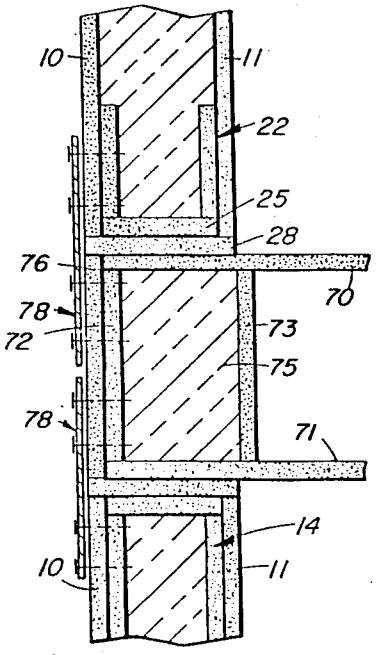
Figure 12:
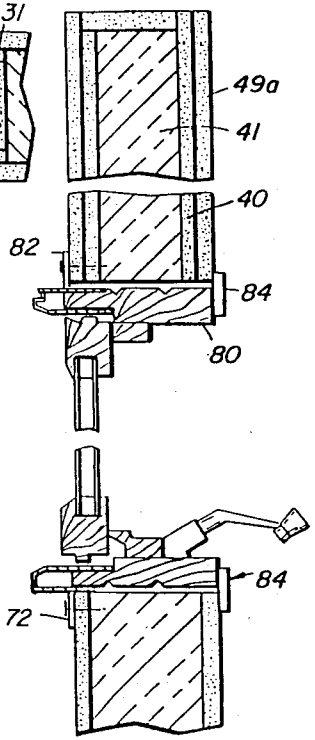
Figure 10:
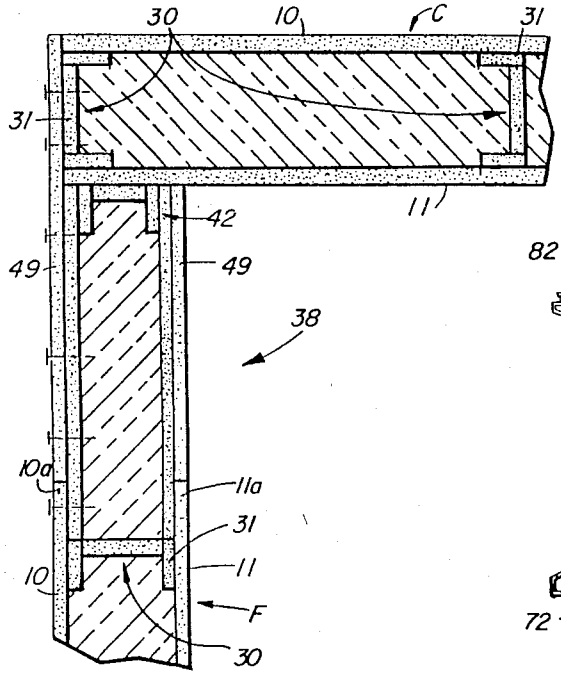
Figure 13:
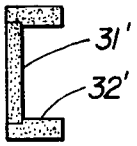
Figure 14:
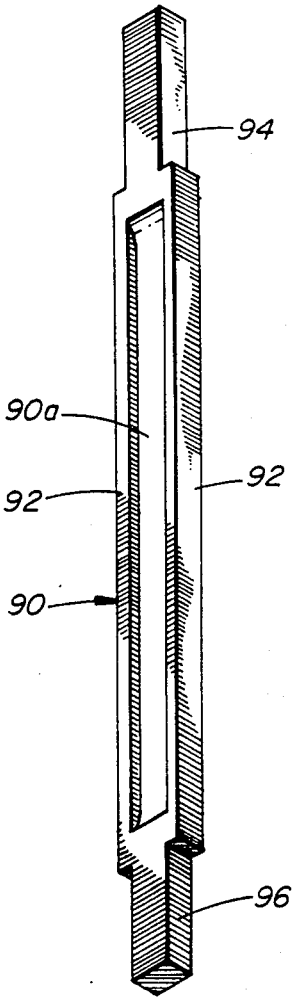

The invention will be further described with reference to the accompanying drawings, in which:

FIG. 1 shows in elevation, a portion of a wall panel connected to an end portion of an adjacent panel, FIG. 2 shows a vertical section of the wall panel, on lines 2—2 of FIG. 1, FIG. 3 shows a horizontal section of the two wall panels taken on lines 3—3 of FIG. 1, FIGS. 4A and 4B show top and edge views of a stud member, FIGS. 5A and 5B show top and side views of a spline used to connect the wall panels, FIGS. 6A and 6B show top and edge exploded views of a wall expander and associated components, FIG. 7 shows a horizontal section through a corner panel, FIG. 8 shows a panel intended to be cut into other components including a wall expander and a spline, FIG. 9A shows a section of wall including part of a door opening and part of a window opening, FIGS. 9B, 9C, 9D and 9E show sections on lines 9B—9B, 9C—9C, 9D—9D and 9E—9E of FIG. 9 respectively, FIG. 10 shows a horizontal section through an alternative corner construction, FIG. 11 shows a vertical section through a wall to floor connection, FIG. 12 shows a vertical section through a panel having a window opening, and FIGS. 13 and 14 show alternative forms of stud members, FIG. 13 being a view similar to FIG. 4A of a first alternative and FIG. 14 being a perspective view of a second alternative.

FIG. 1 shows an end of one wall panel A joined on to an adjacent wall panel B, the latter having a window opening W. Vertical and horizontal sections through the panels are shown in FIGS. 2 and 3.

As best seen in FIG. 2, the wall panel has two outer sheathing boards 10 and 11 separated by rigid foam insulation 12. The boards 10 and 11 may be of plywood, or of so-called oriented strand board which is formed of wafers of wood. The inner board member 11 may also be formed of a smooth material having a finish suitable for internal wall surfaces. The rigid insulation is a foam plastic material, preferably polyurethane.

Along the whole length of the top of the panel there extends a continuous header indicated at 14 and which comprises two upper boards 16 separated by the rigid foam insulation 12. Boards 16 are adhered to the inner surfaces of the boards 10 and 11. Across the upper edges of boards 16 there extends a transverse bearing plate 18 which is also adhered to the foam material 12; a second top plate 20 is installed during erection of the panel but is not an integral part of the panel. As shown in FIG. 1, a window opening W may be cut out having its top immediately underneath the header 14, and this header which is about 12 inches (305 millimeters) in depth is sufficient to support loads acting on the top of the panel over the window, without any other header or reinforcement being required. However, to avoid wastage of material, it is preferred that large window openings at least be accommodated by separate panel elements as described below.

A base reinforcement indicated at 22 extends along the length of the panel. This reinforcement is similar to the header and comprises two lower boards 24 having the same thickness as the upper boards 16. These lower boards are again separated by the rigid foam insulation 12 and adhered to the sheathing boards 10 and 11, and are provided with a base or bearing plate 26 underlying the lower edges of boards 24. The base reinforcement is typically three inches to four inches in height (89 millimeters to 101 millimeters). A further base plate 28 may be installed in the field but this is not an integral part of the panel.

Stud members 30 extend upwardly between the top of the base plate 26 and the bottom of the bearing plate 18, and are located at about 2 foot (610 millimeters) spacing. These stud members are shown separately in FIGS. 4A and 4B. Each stud member comprises a central web 31 formed as a parallel sided board and having extensions **31*a* which fit perpendicularly between the pair of upper boards 16 forming the top header and between the pair of lower boards 24 forming the base reinforcement and so that its ends abut bearing plates 18 and 26. In the region between the lower edges of the upper boards 16 and the upper edges of the lower boards 24 extend flanges 32 secured to the outer edges of the web so that the central part of the stud member is in the form of a channel. The flanges 32 provide parts lying between the edges of the web and sheathing boards 10 and 11 and having the same thickness as the upper and lower boards and such parts thus fill the spaces between the web 31 and the boards 10 and 11 as well as spanning the gap between the upper boards and the lower boards thereby giving support for the header. Conveniently, both web 31 and the flanges 32** are cut from the same material as that of the sheathing boards.

As shown in FIG. 3, the lateral edges of the wall panels have recesses formed by providing boards 10 and 11 with extensions **10*a* and 11*a* protruding beyond the inner parts of the panels and by providing that the stud members at opposite ends of the panel have their flanges projecting inwardly of the webs away from the panel ends. As shown in FIGS. 1 and 3, these recesses allow two panels to be connected end to end by the so-called foam spline 34 which is shown separately in FIG. 5. The foam spline comprises two elongated boards 36 separated by a layer of rigid foam insulation 37. The exterior surfaces of boards 36 fit snugly within the end portions 10*a* and 11*a***, and the spline is attached to the boards of the end portions by screws.

In the preferred method of forming the panel, a first sheathing board 10 is laid on a table. A first bearing plate (such as plate 18) is positioned perpendicularly to board 10 along its marginal edge, being located by a vertical flange attached to the table. A first reinforcing board (such as board 16) is glued to the board 10 and positioned to have its outer edge against the plate 18. A second reinforcing board (such as board 24) is placed close to the opposite margin of the board 10 with glue being applied between these latter boards. The preformed stud members are then put in place and glued transversely of board 10 with the end portions of their web members 31 extending over the boards 16 and 24, each with one end abutting plate 18, and each with one end of its lowermost flange 32 abutting the inner edge of board 16. The position of board 24 may be adjusted if necessary (while the glue is still soft) to bring the inner end of this board against the other end of the lowermost flange 32. As indicated, the outermost stud members are set back from the end of board 10 and arranged so that their flanges face inwardly away from these ends. When positioned, the studs are secured to the board 10 by nails applied by means of an angled nailing device applied internally of the lower flange 32 of the stud member. The plate 18 may also then be nailed to the stud members and the board 16.

The other reinforcing boards 16 and 24 are then applied over the web portions of the stud members and are glued and nailed to the stud members, following which the top board 11 is applied over the studs and the reinforcing boards are glued and nailed in place to the top flanges of the stud members. The bottom bearing plate 26 can then be positioned and stapled to the stud members, and plate 18 nailed to the top board 16 and the top board 11.

It is to be understood that the order of procedure may be varied somewhat, and that in some cases gluing and nailing may not both be required. It will also be understood that nailing can include stapling and that reference to the former include the latter. However, it is important that the panel, before addition of the foam, be sufficiently strong that it can readily be handled. For this reason the stud members are nailed both to the first board 10, the nailing being done internally of the stud member, and to the second board 11 by externally applied nails. For the internal nailing a flange such as flange 32 is required; for the external nailing all that is required is an edge element suitable for receiving nails and having the same thickness as boards 16 and 24; conveniently however this edge element is also a flange.

To allow addition of foam material a series of injection holes is board in the bottom bearing plate 26 with one hole between each pair of adjacent stud members. Vent holes are provided in both the upper and lower bearing plates.

The hollow panel is then moved to a press where a pile of several panels is held between upper and lower rigid platens capable of resisting expansion forces of the foam. With these platens in place, foam is injected through the injection holes, and fills the cavities between studs. Filling can be ensured by checking at the vent holes and/or by closely regulating the amount of foam injected. The finished panel is removed from the platens when the foam has hardened.

Reference has been made to the stud members extending transversely of the sheathing boards. While this will be the case for typical panels having a length greater than their height (the height being 8 feet or 2.44 meters), the invention can also be used to make panels of say 16 feet (4.88 meters) in height, in which case the panel height will be greater than the width. In this case the stud members will of course extend along the longer dimension rather than "transversely".

FIGS. 6A and 6B show a simple wall expander component which can be used to provide a wall extension from about 6 inches (152 mm) to about 2 ft. (610 mm). The thickness of the expander is the same as that of the foam spline shown in FIG. 5 so that this fits snugly within the board portions 10*a*, 11*a* of the two wall panels. This wall expander 38 comprises two rectangular inner boards 40 each having the height of the wall panel and a width of about 2 ft. (610 mm), separated by rigid foam material 41 and having a stud member 42 along one edge; this is similar to the central portion of stud 30 but narrower since boards 40 are closer together than boards 10 and 11. The flanges 42*a* of the stud member project inwardly away from the edge. The upper and lower edges of the expander are closed by plates 44 and 45; additional upper and lower plates 46 and 47 may be field installed. The expander also has two board members 49 abutting the sheathing boards of the panel and which bring the thickness of the expander up to the same dimension as the panels, and these outer boards can be cut to the desired width and inserted between the edges of two panels connected by the expander, to make a smooth transition between panels.

FIG. 7 shows a corner panel 50 adapted to connect with two of the wall panels previously described. The corner panel has outer and inner sheathing boards 52 and 53 which are similar to those of the wall panel and which are similarly spaced, and which each have two halves connected perpendicularly to each other. Board members 55 reinforce the corners of the two outer and inner sheathing boards. Stud members 57 have a web 57*a* and flanges 57*b* similar to those of the central portion of stud 30, and are spaced inwardly from the outer edges of these boards to allow the foam spline to be used to connect the corner panel to an adjacent wall panel. The spaces in between the boards 52, 53 and studs 57 is filled with rigid insulating foam 58.

FIG. 8 shows a section through a panel used as an intermediate stage in the production of various components including the wall expander and spline. As shown, the panel has two sheathing boards 60, spaced to fit between the board portions 10*a*, 11*a* of the wall panels, and having at each end a stud member 42 each of which is the same as member 42 of FIG. 6A. The flanges of each stud member extend inwardly of the panel away from its edge. The centre of the panel is filled with rigid foam material 62. FIG. 8 indicates how the panel can be divided to form:

A:—A wall expander part 38, which is the same as the main part of the wall expander shown in FIG. 6A (i.e. without boards 49); and which can also be cut parallel to its upper and lower edges to form a header panel described below;

B:—A foam spline 34; and

C:—A fill-in element 64 which can be fitted between the edges 10*a* and 11*a* of a wall panel, with the stud web outwards to close the end of a wall panel.

FIG. 9A shows how the components previously described may be used to frame a door and a window. While, as indicated, the continuous header allows such apertures to be cut from the panel at any desired location under the header, the arrangements shown in FIG. 9 are preferred except for small window apertures.

As shown, the side of door opening D is framed by the fill-in element 64 which is fitted between the extending board edges 10*a* and 11*a* of the wall panel; this provides a substantially flush end for the wall panel largely constituted by the web portion of stud member 42. This fill-in element also serves to support a header panel 38*a* which is, in effect, a horizontal slice of the wall expander 38 formed from the panel shown in FIG. 8. Each end of this header panel is received between panel board edges 10*a* and 11*a* and rests on a fill-in element 64. The header has outer board members 49*a* corresponding to board members 49 of the wall expander and which bridge the gaps between adjacent edges of the wall panel sheathing boards.

The structure above and beside the window opening W' is the same as that above and beside the door opening. Below the window extends a portion of a wall panel cut to suitable height and joined to each adjacent wall panel with spline 34, as shown in FIG. 9E.

FIG. 10 shows an alternative corner construction which does not require a special corner panel, but which instead makes use of the wall expander 38 shown in FIG. 6. In this construction, a first wall panel C is prepared by havings its protruding board edges 10*a* and 11*a* cut off to expose web 31 of a stud member. The other panel F has wall expander 38 inserted into its edge recess, with its stud member 42 at its outer end. The expander may be cut to whatever width is required for the particular design. The facing boards 49 of the expander are then cut so that the interior board spans the gap between the edge of sheathing board 11 of the panel F and the associated inner face of the panel C, and the outer board of the wall expander is cut so that it overlaps with the end of panel C and makes a smooth joint with the sheathing board 10 of panel F. The outer board is then screwed into place as shown, and screws are also inserted through the thickness of the panel C into the end of the wall expander.

FIG. 11 shows the joints between the bottom of a standard wall panel, the edge portion of a floor panel, and the upper edge of a basement wall panel which is similar to the standard wall panel (although usually of less height to go on a concrete basement wall). The floor panel has upper and lower sheathing boards 70 and 71, held apart by an edge formation provided by outer and inner elongated boards 72 and 73 separated by a layer 75 of rigid foam. An outer plate 76 is screwed around the edges of the floor panel. The outer surface of board 76 is flush with the outer surfaces of the boards 10 of the wall and basement panels, and these boards are connected by metal connecting clips 78 which are nailed or screwed to the board members.

FIG. 12 shows how a standard window frame is fitted into a standard wall panel, with the frame coming just underneath the bottom of the header. The window frame 80 is equipped with a metal or plastic nailing fin 82 all around the window to secure this to the outer sheathing board 10. Strips of wood 84 on the inner side of the window frame secure this to the lower edge of the outer header board member 49*a*. Since the header supports the forces applied to the top of the wall panel there is no need for any additional framing around the window opening other than that provided by standard available window frames, of the type illustrated.

The wall panels as described may be used in combination with the floor panel shown in FIG. 11, with foam insulated roof panels, and uninsulated interior wall panels. The roof panels will have outer and inner sheathing boards similar to those of the wall panels and will have stiffeners formed by board members set perpendicularly to the sheathing boards. The interior wall panels may comprise two sheathing boards, which may be of gypsum, and have a hollow interior bounded by upper and lower closure elements which may be similar to the base reinforcement 22 used in the wall panels.

FIG. 13 shows a view similar to that of FIG. 4A of a modified stud member in which the flanges 32' are thicker than the boards 16 and 24 of the wall panel, but are provided with rabbets so that the parts of the flanges 32' which lie between the edges of web 31' and the sheathing boards are of equal thickness to the boards 16 and 24.

FIG. 14 shows a molded stud member 90 which may be used as an alternative to the fabricated stud members previously described. This is preferably molded of high density polyurethane foam, having a density and strength considerably greater than that of the insulating foam 12. Such material is available as a substitute for wood. The stud member has a central web **90*a* formed by a longitudinal recess which provides a nailing flange 92 along each edge, and having one end extensions 94 sized to fit between the pair of upper boards 16 and an opposite end extension 96 sized to fit between the pair of lower boards 24. The flanges 92 are identical and dimensioned to extend between the adjacent edges of the upper and lower boards and dimensioned to fit closely within the sheathing boards 10 and 11. The flanges are shaped to permit one of the flanges to be nailed internally to the first board 10**. While only one flange is required to be nailed internally, it is preferable to have the flanges identical so that the stud members at opposite ends of a panel can both have their open sides facing inwardly.

We claim:

1. A wall panel of the type having two outer sheathing boards separated by rigid foam insulation, wherein the panel has a continuous top header extending the full length of the panel which header comprises a pair of upper boards located against upper margins of the opposed interior surfaces of the sheathing boards and further comprises a transverse top bearing plate overlying the upper edges of said upper boards, the panel also having a base reinforcement comprising a pair of lower boards having the same thickness as said upper boards and located against lower margins of said interior surfaces and a transverse lower bearing plate underlying the edges of the lower boards; the panel further comprising a series of vertical stud members each having a central web and a nailing flange along one edge of said web, said flange being internally nailed to one of said sheathing boards and said web having an opposite edge element holding nails applied through said other sheathing board, said central web having extensions fitting between said pair of upper boards to said top bearing plate and between said pair of lower boards to said lower bearing plate, and said flange and edge element providing parts lying between the edges of the web and said sheathing boards, said parts having a thickness equivalent to said upper and lower boards and spanning the vertical spaces between adjacent edges of said upper and lower boards; all spaces between said sheathing boards and upper and lower pairs of boards being filled with said rigid foam insulation.

2. A wall panel according to claim 1, wherein said web of each said stud member is a parallel sided board dimensioned so that its end extensions fit perpendicularly between the pairs of upper and lower boards, and wherein said nailing flange and said opposite edge element are each constituted by a strip of board material of the same thickness as said upper and lower boards and secured perpendicularly to the outer edges of said web.

3. A panel according to claim 1 wherein said flanges and said web together form a channel portion of said stud member, and wherein stud members at opposite ends of the panel have their open sides facing inwardly with their web members spaced inwardly of the outer end edges of the sheathing boards.

4. A panel according to claim 1, wherein said stud members are integrally formed of foam material having a density higher than said foam material which fills said spaces.

5. A method for making a wall panel having two outer sheathing boards separated by rigid foam insulation comprising the steps of:

laying down a first of said sheathing boards;

positioning a bearing plate perpendicularly to said sheathing board along a first marginal edge thereof and positioning and securing a first reinforcing board along a margin of the sheathing board with its edge abutting said bearing plate;

placing a second reinforcing board close to the opposite margin of said sheathing board;

locating stud members transversely between said reinforcement boards, each said stud member having a central web with end portions extending over said reinforcement boards and having a nailing flange located against said sheathing board between the adjacent edges of the reinforcement boards and having an edge element on the opposite side of said web member from said nailing flange and co-extensive with said flange; and adjusting if necessary the position of said second reinforcement boards so that adjacent edges of said boards abut each end of said nailing flange;

nailing said nailing flange of each stud to said first sheathing board;

placing third and fourth reinforcement boards on the web members of said stud members and locating said latter boards with edges against ends of the edge elements of said boards;

placing a second bearing plate against the free ends of said stud members and the outer edges of said second reinforcing boards and securing both the bearing plates to said stud members and said reinforcing boards;

locating a second sheathing board on said third and fourth reinforcing boards and on the edge elements of said stud members and nailing to said reinforcing boards;

providing foam apertures in one of said bearing plates between said stud members and foaming plastic foam material into the cavities between the studs while the sheathing boards are held by a press.

* * * * *